United States Patent [19]

Deulofeu

[11] 4,063,381

[45] Dec. 20, 1977

[54] ARTICULATED PUPPET

[76] Inventor: Jorge M. Deulofeu, Avd$^a$ Jose Antonio No. 292, Barcelona, Spain

[21] Appl. No.: 707,024

[22] Filed: July 20, 1976

[30] Foreign Application Priority Data

| | | |
|---|---|---|
| July 24, 1975 | Spain | 214210 |
| Dec. 24, 1975 | Spain | 217678 |
| Dec. 27, 1975 | Spain | 217725 |
| May 1, 1976 | Spain | 217881 |

[51] Int. Cl.$^2$ ..... A63H 3/00

[52] U.S. Cl. ..... 46/22; 46/161; 46/164

[58] Field of Search ..... 46/22, 151, 161, 163, 46/164, 173

[56] References Cited

U.S. PATENT DOCUMENTS

| | | | |
|---|---|---|---|
| 3,018,583 | 1/1962 | Novotney | 46/22 |
| 3,740,894 | 6/1973 | Howland | 46/161 |
| 3,938,277 | 2/1976 | Goldfarb et al. | 46/161 |
| 3,946,517 | 3/1976 | Goldfarb et al. | 46/22 |
| 3,995,395 | 12/1976 | Rahmstorf | 46/22 |

*Primary Examiner*—Louis G. Mancene
*Assistant Examiner*—Robert F. Cutting
*Attorney, Agent, or Firm*—Bacon & Thomas

[57] ABSTRACT

A puppet of resilient material is formed of separate parts adapted to be assembled by snapping enlarged projections of some parts into restricted openings of other parts to hold them assembled while permitting relative movement between them.

5 Claims, 6 Drawing Figures

ARTICULATED PUPPET

BACKGROUND OF THE INVENTION

This invention is in the field of articulated puppets or dolls. Many articulated puppets or dolls have been made but they all require some skill for a child to assemble and manipulate.

The present invention involves a simple doll or puppet structure comprising separable parts of resilient material capable of being easily snapped together by a child to be held in assembled relationship and yet capable of having the various body members moved relative to each other to lifelike different positions. It is, therefore, an object of the invention to provide a puppet of separate parts capable of being readily assembled and manipulated and which is stable, durable and economically made.

DESCRIPTION OF A PREFERRED EMBODIMENT

Figure 1:
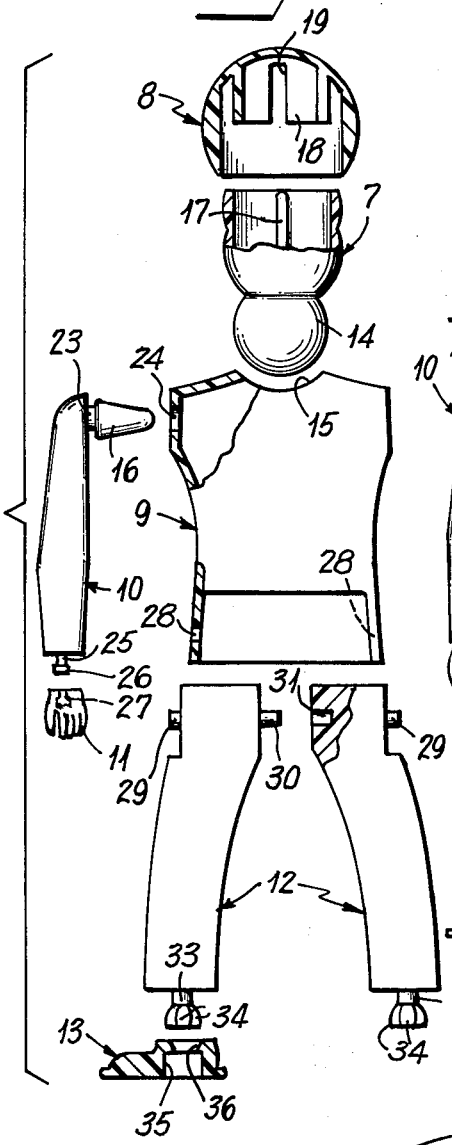
FIG. 1 is an exploded view of parts of the puppet, certain duplicate parts being omitted.

As shown in FIG. 1, the puppet comprises a hollow simulated head 7 having a spherical ball projection 14 at the bottom thereof, a simulated hairpiece 8, a simulated torso 9, arms 10, hands 11, legs 12, and feet 13.

Figure 2:
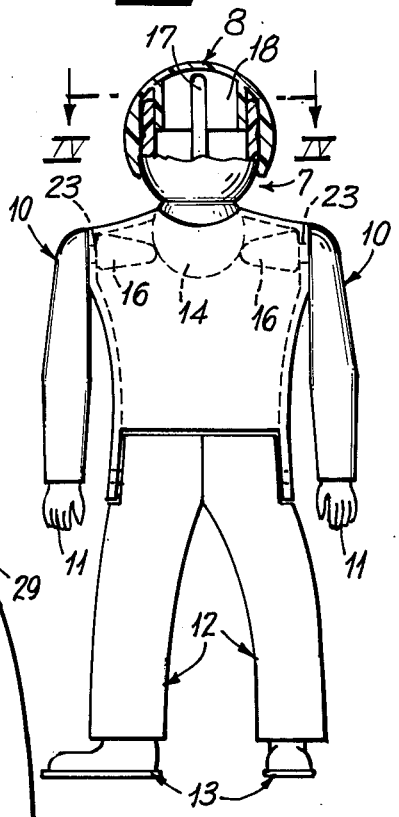
FIG. 2 is a front elevational view of the assembled pupped with parts thereof being shown in section.

The torso 9 is of hollow construction and open at the bottom as illustrated and is constructed of resilient material preferably a suitable plastic, as are all of the parts of the puppet. The torso is provided with a neck opening 15 adapted to receive the spherical projection 14 of the simulated head whereby the latter is pivotal with respect to the torso. The diameter of the projection 14 is slightly greater than the diameter of opening 15. In the shoulder regions of the torso, openings 24 are provided and arms 10 having inwardly extending integral projections, at their upper ends comprising a neck portion 23 and a conical head 16. The large diameter of the heads 16 is somewhat larger than the openings 24 so that the arms may be snapped into the openings and held therein, as shown in FIG. 2, but capable of pivotal movement about the axis of neck 23. As also shown in FIG. 2, the spherical portion 14 of the head frictionally engages the tips of the cones 16 and is thereby frictionally held in any desired position of pivotal adjustment of the head 7 relative to the torso 9, the cones 16 limiting the distance the projector 14 can enter the torso. Each arm 10 is provided at its lower end with an extending member having a neck portion 25 and an enlarged head 26 adapted to be snapped into an opening 27 in a resilient hand member 11. Thus, the hand is supported for pivotal movement about the axis of 25 in simulation of an arm and wrist joint.

Figure 3:
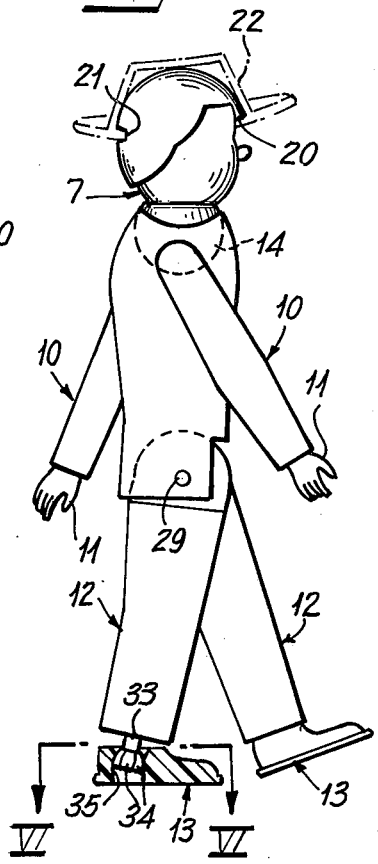
FIG. 3 is a side elevational view of the assembled puppet.
Figure 4:
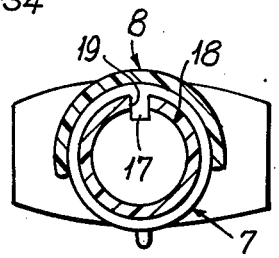
FIG. 4 is a transverse sectional view taken on the line IV—IV of FIG. 2.
Figure 6:
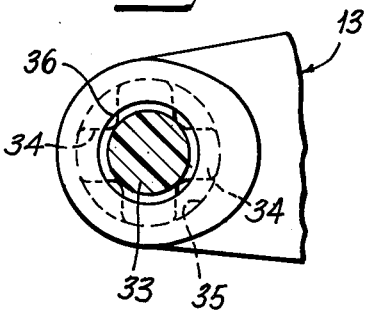
FIG. 6 is a sectional view of an enlarged scale taken on the line VI—VI of FIG. 3.

As stated previously, the head 7 is hollow and is upwardly open at its top, as seen in FIG. 1. The inner surface is provided with an upstanding rib 17. A simulated hairpiece 8 is configured to fit over the open upper end of the head and is provided with an inner cylindrical sleeve portion 18 adapted to enter the opening in the top of the head and which is provided with a slot 19 arranged to embrace the rib 17 and thus hold the simulated hairpiece in properly oriented position on the head 7. As shown in FIGS. 3 and 4, the simulated hairpiece 8 is also provided with a recess or slot 21 at the rear of the head and defines a generally downwardly facing shoulder 20 in the region of the brow of the doll. The recess 21 and shoulder 20 are useful in engaging and holding a simulated hat 22 on the puppet or doll.

As stated above, the torso 9 is open at its bottom and is provided with opposed aligned openings 28 through the sides thereof in the region of the hips of the simulated figure. A pair of legs 12 are formed with adjacent inner surfaces at their upper ends adapted to slidably abut each other and from one of the surfaces a first pivot member or pin 30 extends and the other of the surfaces is provided with a socket 31 adapted to pivotally receive the pivot member 30. On the outer sides of the legs 12, second pivot pins 29 extend outwardly in opposite directions and in axial alignment with each other and with the pin 30 when the figure is assembled. To assemble the figure, the first pivot pin 30 is placed in recess 31 and the bottom portion of torso 9 is resiliently distorted to spread its sides apart sufficiently to receive the assembled legs and then released to cause the aligned second pivot pins 29 to extend pivotally into openings 28. Thus, the legs are pivotally supported in the torso for individual pivotal movement relative to each other and to the torso.

Figure 5:
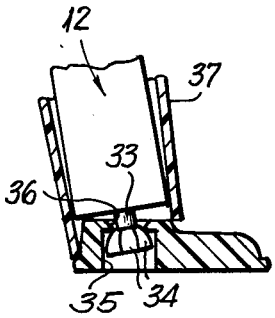
FIG. 5 is a vertical sectional view, on an enlarged scale, taken through the lower portion of a leg and foot of the device.

At the lower end thereof each leg 12 has a pintle 33 (see FIG. 5) extending downwardly and terminating in laterally or radially extending projections 34. Simulated feet 13 have recesses 35 formed therein and a smaller opening 36 through their upper surfaces. The openings 36 are as large as the pintles 33 but smaller than the outer diameter of the projections 34. Thus, the projections may be resiliently bent and snapped through the openings 36 and function to pivotally hold feet 13 on the legs 12. If desired, a spatterdash 37 may be placed around the lower portion of the legs 12 and will assist in aligning the parts for assembly of the legs 12 and feet 13 in the manner described.

The details of construction as described above may be varied within the scope of the appended claims.

I claim:

1. An articulated puppet having a hollow torso member of resilient material, said torso member being open at the bottom;

aligned openings through the sides of said torso member adjacent the open bottom thereof;

a pair of puppet legs having inner abutting surfaces at their upper ends, a first pivot pin projecting from one of said surfaces into an opening in the other surface pivotally joining said legs;

a second pivot pin projecting outwardly from each of said legs, in axial alignment with said first pivot pin, and extending into said aligned openings in said torso member whereby said aligned pins define simulated hip joints for said puppet, said open bottom of said torso member being resiliently distortable to permit engagement and disengagement of said pivot pins in said aligned openings.

2. An articulated puppet as defined in claim 1 including a pair of arms for said puppet, each arm having at its upper end an inwardly directed projection extending pivotally into a pivot opening in the shoulder region of said torso member and having at its inner end an enlarged conical head, of greater diameter than said pivot opening;

the lower end of each of said arms having a pivot member extending axially therefrom into a pivot opening in a simulated hand, said pivot members having enlarged heads thereon to hold said simulated hands on said pivot members.

3. An articulated puppet as defined in claim 1 wherein each of said puppet legs is provided at its lower end with a pintle having a neck portion and radially extending enlargements therebelow;

a simulated foot for each puppet leg, each foot being of resilient material and having a cavity therein and an opening to said cavity smaller than said enlargements and embracing said neck portion.

4. An articulated puppet as defined in claim 2 wherein said torso member has a neck opening through its top;

a simulated head having a spherical extension, of a diameter slightly greater than said opening, extending through said neck opening, said extension bearing slidably against the ends of said conical heads;

said simulated head being hollow and open at the top and having a vertical rib on its inner surface;

a simulated hairpiece overlying the top of said simulated head and having means extending downwardly into said open top of said head and being provided with a portion embracing said rib to thereby hold said simulated hairpiece in proper orientation to said head.

5. An articulated puppet as defined in claim 4 wherein said simulated hairpiece is provided with a brow portion at the front thereof defining a generally downwardly facing shoulder and a recess at the rear thereof, said shoulder and recess comprising means for releasably holding a toy hat or the like on said simulated head.

* * * * *